US005480334A

United States Patent [19]

Wilson et al.

[11] Patent Number: 5,480,334

[45] Date of Patent: Jan. 2, 1996

[54] NESTED AUTOMATICALLY SEPARABLE FLYING DISK ASSEMBLY

[76] Inventors: James M. Wilson, 3330 Templeton Gap Rd. #32, Colorado Springs, Colo. 80907; Dean M. Wilson, 1071 Warren Rd., No. 10, Ithaca, N.Y. 14850

[21] Appl. No.: 231,165

[22] Filed: Apr. 22, 1994

[51] Int. Cl.[6] ..... A63H 27/00

[52] U.S. Cl. ..... 446/46

[58] Field of Search ..... 446/46–48; 273/424, 273/428; D21/85, 86

[56] References Cited

U.S. PATENT DOCUMENTS

| | | | |
|---|---|---|---|
| 3,724,122 | 4/1973 | Gillespie, Sr. | 446/46 |
| 3,855,728 | 12/1974 | Hynds | 446/46 |
| 4,176,843 | 12/1979 | DeWitt, Jr. | 273/424 X |
| 4,516,946 | 5/1985 | Rodarte | 446/46 |
| 4,819,947 | 4/1989 | Mackey | 273/424 X |

*Primary Examiner*—Mickey Yu
*Attorney, Agent, or Firm*—Phillip A. Rein

[57] ABSTRACT

The nested automatically separable flying disk assembly includes an outer or cover disk assembly enclosing a nested or inner disk assembly. The outer or cover disk assembly is of a generally cylinderical disk shape having an air space between itself and the nested or inner disk assembly provided by a central nub projection cooperating with flange nub projections. The nested or inner disk assembly is provided with an outer peripheral flange section extended downwardly and below a similar peripheral rim section on the outer or cover disk assembly for allowing air to flow therebetween to cause the desired separation between the nested disk assemblies. An adjustable central nub projection is provided to adjustably change separation between the outer or cover disk assembly and the nested or inner disk assembly. The nested or inner disk assembly is provided with a plurality of inclined concentric aerodynamic ridges to alter air flow and resultant turbulence of air flow between the nested disk assemblies to vary the aerodynamic flight characteristics thereof. Second and third embodiments provide different angular relationships, either inwardly or outwardly, of the outer adjacent peripheral rim section of the outer or cover disk assembly and the peripheral flange section of the nested or inner disk assembly to achieve an increase or decrease in the time of separation of the outer or cover disk assembly from the nested or inner disk assembly.

15 Claims, 3 Drawing Sheets

NESTED AUTOMATICALLY SEPARABLE FLYING DISK ASSEMBLY

A patent search revealed the following United States patents:

| Patent No. | Invention | Inventor |
|---|---|---|
| 3,359,678 | FLYING SAUCER | Edward E. Headrick |
| 3,724,122 | FLYING SAUCER | Richard L. Gillespie, Sr. |
| 3,855,728 | AERODYNAMIC TOY | William B. Hynds |
| 4,182,073 | TWIN FLYING SAUCER TOY | Michael A. Tabet |
| 4,212,131 | HIGH UTILITY DISK TOY | Alexander D. Ross, Jr. |
| 4,288,942 | AERODYNAMIC DEVICE | Thomas H. Nicholl |
| 4,334,385 | FLYING DISC | Melin et al |
| 4,503,635 | FLYING DISC WITH WEIGHTED OUTER RING | Richard H. Harrington |
| 4,752,267 | DOUBLE FLYING DISC | Robert Layman |
| 5,041,042 | FLYING BUBBLE TOY | David Stein |

The Headrick patent which issued in 1967 appears to be an original flying saucer owned and sold by Wham-O Manufacturing Company.

The Gillespie, Sr., Nicholl, Melin et al, and Harrington patents disclose various flying saucers or disks to increase air flow having changable outer edges or weights added thereto.

The Tabet and Layman patents disclose the use of dual disks but they do not separate during flight.

The Ross Jr. patent discloses the nesting of a smaller disk within a larger disk and having them separate in flight.

The Stein patent discloses various types of flying toys that produce bubbles during flight.

PREFERRED EMBODIMENT OF THE INVENTION

In one preferred embodiment of this invention, a nested automatically separable flying disk assembly is utilized between two or four players as an exercise and/or game method of usage.

The nested automatically separated flying disk assembly includes an outer or cover disk assembly operable to receive therein a nested or inner disk assembly.

In a method of game play, the nested automatically separable flying disk assembly can be thrown from one game player to a receiving game player. The receiving game player would attempt to catch the outer or cover disk assembly and the nested or inner disk assembly, which had been thrown by the first game player, before either disk assembly contacts a ground support surface. With the disk assemblies being automatically separable in flight, this provides a challenging exercise or game method of play.

Another method of exercise and/or game play would be with two players on each side. The two (2) receiving players would individually catch one of the separated disk assemblies before touching the ground support surface.

In either of the methods of game play, a scoring system could be utilized to determine an ultimate winner(s) as will be described.

The outer or cover disk assembly includes a central body section having an outer circular edge integral with an intermediate or inclined support section which, in turn, is integral with an outer flange section that is integral with a peripheral rim section.

The central body section is provided with an outer wall surface and an inner wall surface being of a flat plate material preferably constructed of a plastic material or the like. The inner wall surface is provided with a central nub projection being of cylindrical shape for reasons to be explained.

A second embodiment of the central body section with the outer wall surface and the inner wall surface is that the inner wall surface is provided with an adjustable central nub projection. More particularly, the central nub projection provides a nub support hub having a central threaded hole adapted to receive a threaded screw member therein. The threaded screw member is adjusted longitudinally and operable to be in contact with the nested or inner disk assembly to provide an adjustment of distance between the outer or cover disk assembly and the nested or inner disk assembly for reasons to be explained.

The intermediate or inclined support section is provided with an inclined ring portion having a top connector portion integral with the outer periphery of the central body section and a flange connector portion which is integral with an adjacent portion of the outer flange section.

The outer flange section is provided with a top wall surface and an inner wall surface and being of a plate construction similar to the central body section. The inner wall surface is provided with a pair of flange nub projections diametrically opposed to each other and being cylindrical in shape similar to the central nub portion in the central body section.

The peripheral rim section extends downwardly and perpendicular to the outer flange section and includes 1) an inner wall; 2) a bottom wall; and 3) an arcuate outer wall.

The nested or inner disk assembly includes a top wall section of a circular plate construction having an outer circular edge being integral with an intermediate or inclined flange section which, in turn, is integral with an outer connector flange section that is integral with a peripheral flange section extended perpendicular to the outer connector flange section.

The intermediate or inclined flange section is provided with a first inclined portion integral with the top wall section and further integral with a second inclined portion. The second inclined portion is provided with an upper surface having a plurality of adjacent aerodynamic ridges for reasons to be explained.

The outer connector flange section is provided with a top wall portion integral on one end with the second inclined portion of the intermediate or inclined flange section. The top wall portion is also provided with a plurality of the aerodynamic ridges for reasons to be explained.

The peripheral flange section is provided with 1) an inner flange surface; 2) an outer flange surface; and 3) an outer bottom wall surface. The peripheral flange section is of a generally cylindrical shape.

In the first embodiment, the peripheral flange section and, more particularly, the outer flange surface is extended parallel to the inner wall of the peripheral rim section of the outer or cover disk assembly and perpendicular to the central body section and the top wall section, respectively, for use and operation as will be explained.

As noted in FIG. 6, there is a second embodiment in regard to the peripheral rim section of the outer or cover disk assembly and the peripheral flange section of the nested or inner disk assembly. More particularly, the inner wall of the outer or cover disk assembly and the outer flange surface of the nested or inner disk assembly are angled outwardly relative to each other in spaced parallel planes. The variable angular distance outwardly, as noted by a letter "D", operates to provide means of air flowing between the spaced peripheral rim section and the peripheral flange section to cause a separation of the outer or cover disk assembly and the nested or inner disk assembly automatically and sooner during air flight as will be explained.

In a third embodiment, as noted in FIG. 7, the peripheral rim section of the outer or cover disk assembly is inclined inwardly at its inner wall as noted by a letter "E".

Additionally, the peripheral flange section of the nested or inner disk assembly is inclined inwardly, as noted by the letter "E", from its connection to an outer connector flange section.

In this third embodiment, the inner wall of the outer or cover disk assembly and the outer flange surface of the nested or inner disk assembly are extended in spaced parallel planes at a predetermined angle. Therefore, separation of the outer or cover disk assembly from the nested or inner disk assembly occurs at a later time in flight due to aerodynamic reasons as will be explained.

Of the nested automatically separable flying disk assembly as noted in FIG. 1, it is seen that, on throwing of the nested automatically separable flying disk assembly by an exercise or game player, at a certain point, depending on the speed and thrust of throwing the nested automatically separable flying disk assembly, the outer or cover disk assembly and the nested or inner disk assembly will separate in flight whereupon they may be respectively caught by the other two exercise or game players as noted in FIG. 1.

Further, the nested automatically separable flying disk assembly can be utilized between two exercise or game players whereupon the receiving game player would catch one of the disk assemblies first and then proceed to catch the second separated disk assembly as noted in FIGS. 2*a* and 2*b*.

OBJECTS OF THE INVENTION

One object of this invention is to provide a nested automatically separable flying disk assembly having an outer or cover disk assembly operable to receive within it outer periphery a major portion of a nested or inner disk assembly whereupon the outer or cover disk assembly and the nested or inner disk assembly are separable after being thrust into flight due to aerodynamic fluid pressure to achieve a new, novel, and unusual exercise or game assembly and method of game play.

Another object of this invention is to provide a nested automatically separable flying disk assembly having a new and novel construction so as to be operable to vary the aerodynamic characteristics and the time of separation of an outer or cover disk assembly from a nested or inner disk assembly to increase the variety of pleasure derived therefrom during a method of exercise or game play.

One other object of this invention is to provide a nested automatically separable flying disk assembly including a nested or inner disk assembly placed within outer peripheral confines of an outer or cover disk assembly and having new and novel aerodynamic features to achieve separation of the outer or cover disk assembly from the nested or inner disk assembly being variable depending on 1) the force at which the nested automatically separable flying disk assembly is thrust into the atmosphere and 2) the angle of thrusting similar to a Frisbee flying disk.

On further object of this invention is to provide a nested automatically separable flying disk assembly with an adjustable feature whereupon space between an outer or cover disk assembly and a nested or inner disk assembly can be selectively adjustable to achieve variable aerodynamic characteristics on thrusting the nested automatically separable flying disk assembly into the atmosphere to vary the time of flight before separation to achieve a new and novel method of exercise and/or game play with this invention.

Still, one other object of this invention is to provide a nested automatically separable flying disk assembly which provides a method of game play much superior to utilization of a single flying disk member; is sturdy in construction; is economical to manufacture; and is substantially maintenance free.

Various other objects, advantages, and features of the invention will become apparent to those skilled in the art from the following discussion, taken in conjunction with the accompanying drawings, in which:

FIGURES OF THE INVENTION

FIG. 1 is a schematic diagram illustrating a method of play between a team of exercise and/or game players with two on a side having a nested automatically separable flying disk assembly shown as separated with a disk assembly to be caught by a respective one of the receiving team of exercise and/or game players;

FIG. 2*a* is similar to FIG. 1 except having two exercise and/or game players, one on each side, and showing the receiving exercise and/or game player prepared to grasp one of the separated disk assemblies;

FIG. 2*b* is similar to FIG. 2*a* showing the receiving exercise and/or game player having caught a first disk assembly and reaching to catch the second separated disk assembly;

Figure 3:
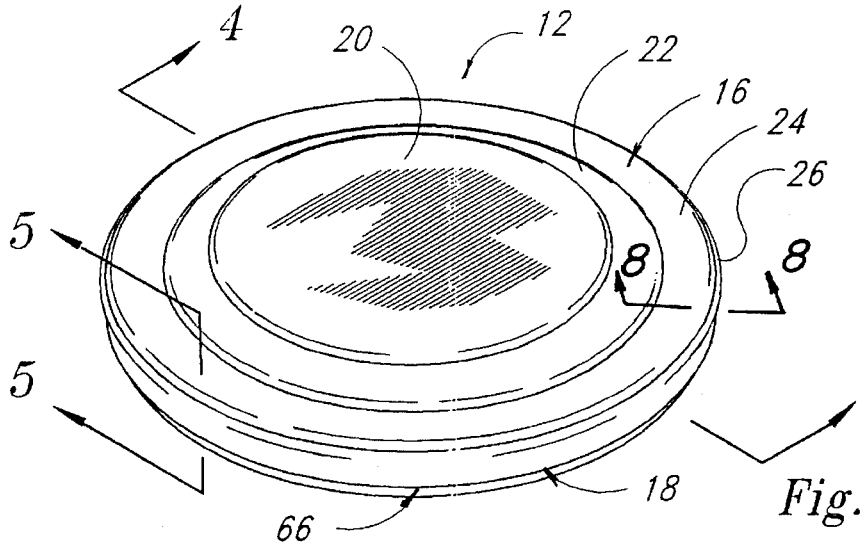
FIG. 3 is a perspective view of the nested automatically separable flying disk assembly of this invention.
Figure 8:
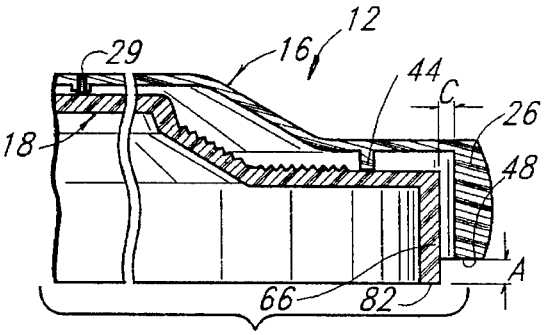
Figure 9:
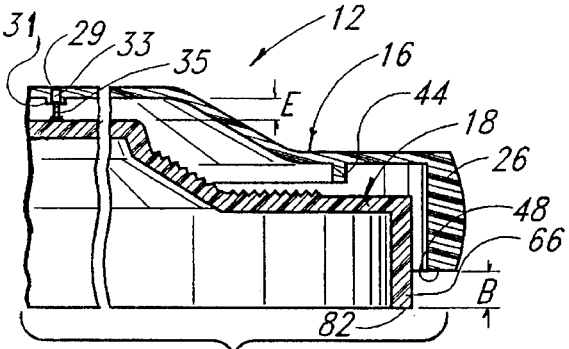
Figure 10:
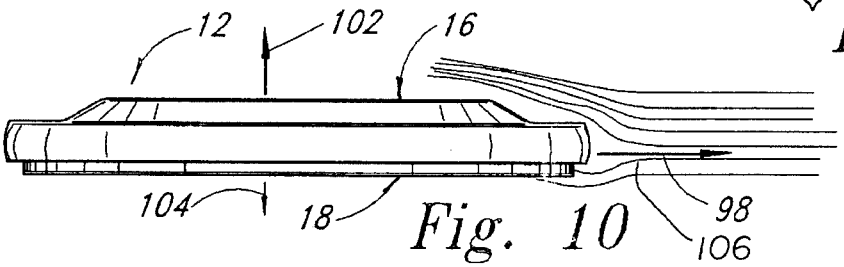
Figure 11:
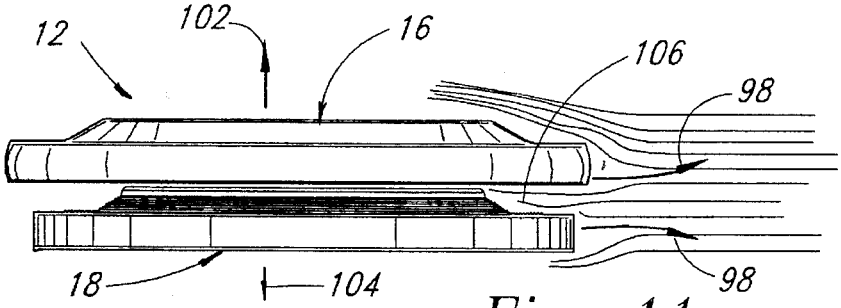
Figure 12:
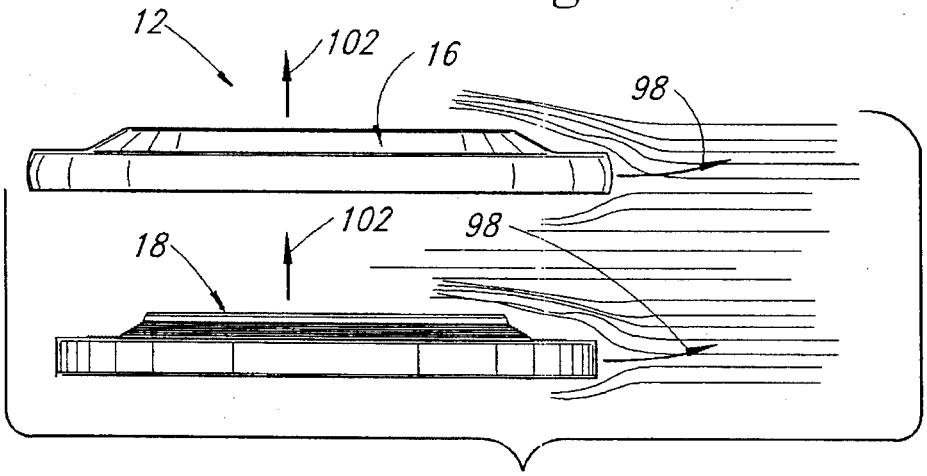

FIGS. 8 and 9 are fragmentary foreshortened sectional views taken along line 8—8 in FIG. 3 illustrating an adjustable feature of the nested automatically separable flying disk assembly of this invention; and FIGS. 10, 11, and 12 are schematic diagrams illustrating the nested automatically separable flying disk assembly operating in propelled flight and various aerodynamic forces acting thereon to achieve the desired and variable separation of the disk assemblies.

The following is a discussion and description of preferred specific embodiments of the nested automatically separable flying disk assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
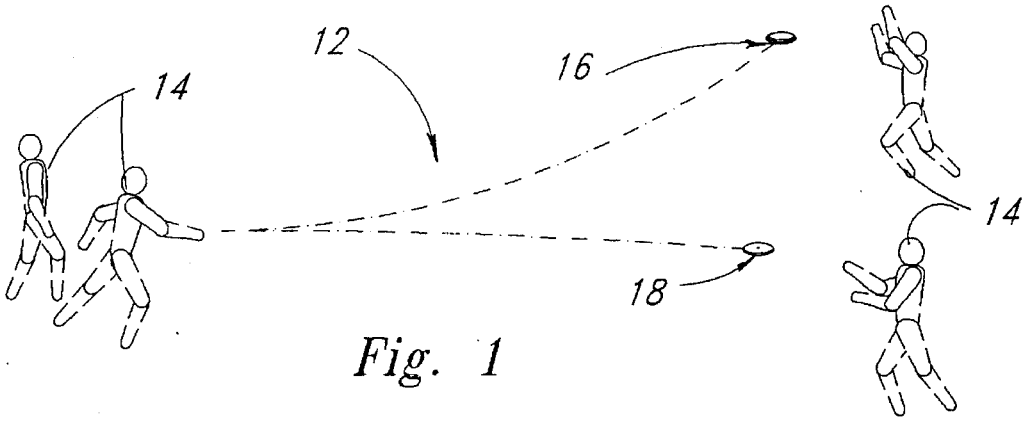

Referring to the drawings in detail, and in particular to FIG. 1, a nested automatically separable flying disk assembly of this invention, indicated generally at 12, is utilized by a pair of exercise and/or game players 14 in a method of game play of this invention.

Figure 4:
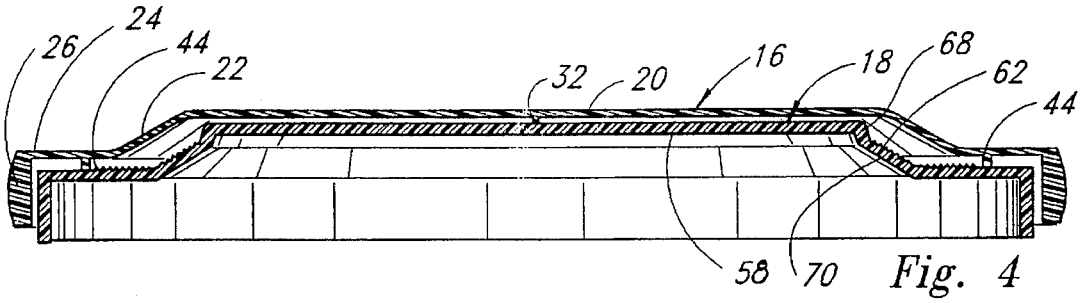
FIG. 4 is an enlarged sectional view taken along line 4—4 in FIG. 3.

The nested automatically separable flying disk assembly 12 includes an outer or cover disk assembly 16 having a nested or inner disk assembly 18 illustrated in a nested condition as indicated in FIGS. 3 and 4.

In the method of game play, as noted in FIG. 1, it is seen that there are two exercise and/or game players 14 on each side of a game playing area engaged in the throwing of the nested automatically separable flying disk assembly 12 from one game player 14 on one side to two receiving game players 14 on an opposite side of the game playing area.

It is noted that, after being tossed by the one game player 14 to the receiving game players 14, the outer or cover disk assembly 16 with the nested or inner disk assembly 18 separates from the nested or inner disk assembly 16. Each game player 14 on the receiving side would have a responsibility to catch the outer or cover disk assembly 16 and/or the nested or inner disk assembly 18 before either would contact a ground support surface.

The method of game play could be such that the first team of game players 14 to first reach a total score of 25, being one (1) point for catching the disk assemblies 16, 18 in flight, would be the overall team winners which may equal one set of game play. This method of game play could be similar to tennis as the team winners would be the team to win two (2) sets out of three (3).

Figure 2A:
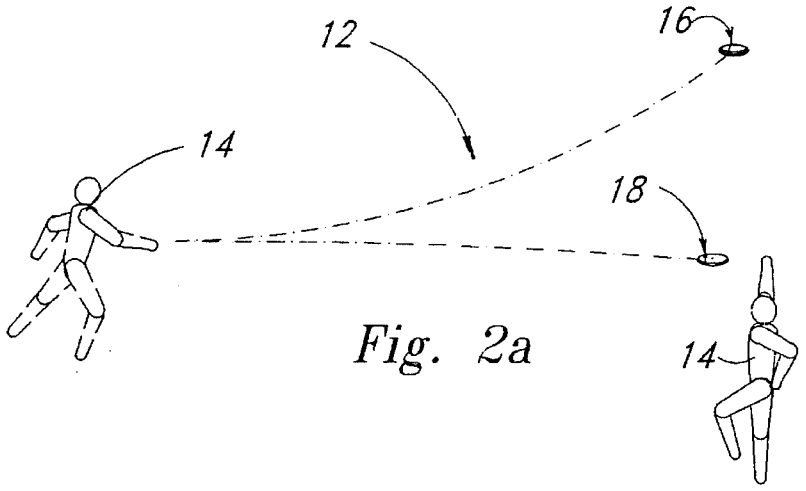
Figure 2B:
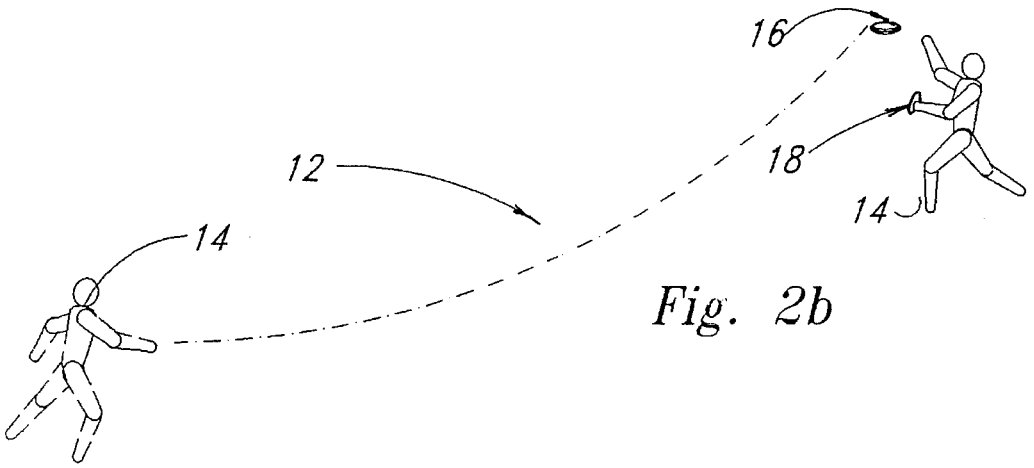

As noted in FIGS. 2*a* and 2*b*, a second method of game play is utilized whereupon a game player 14 is placed on opposite sides of the game playing area similar to a flying disk method of game play. In this case, a flying disk is tossed from one game player 14 to a receiving game player 14 to catch before the flying disk contacts a ground support surface.

However, with the nested automatically separable flying disk assembly 12 in a method of game play using two (2) game players 14, the receiving game player 14 would try to first catch the outer or cover disk assembly 16 or the nested or inner disk assembly 18 and then catch the remaining disk assembly 16, 18 before it hits the ground support surface.

As shown in FIG. 2*a*, an initial tossing of the nested automatically separable flying disk assembly 12 is shown whereupon the receiving game player 14 catches the nested or inner disk assembly 18 and then proceeds, as noted in FIG. 2*b*, to catch the outer or cover disk assembly 16 before it hits a ground support surface.

The scoring of this method of game play between two game players 14 could be similar as previously described as having the first to reach a total number of points, such as 25, declared the winner. Again, this would be similar to the game of tennis whereupon the winner of two (2) out of three (3) or three (3) out of five (5) sets would determine the overall winner in this method of game play.

As noted in FIG. 3, the outer or cover disk assembly 16 includes a central body section 20 integral about an outer periphery with an intermediate or inclined support section 22 which, in turn, is integral with an outer flange section 24. An outer circumferential edge of the outer flange section 24 is integral with a peripheral rim section 26.

The central body section 20 is of a flat plate construction having an outer wall surface 28 and an inner wall surface 30. The inner wall surface 30 is provided at a center thereof with a downwardly depending central nub projection 32 which is of a cylindrical shape. The central nub projection 32 provides support and spacing between the central body section 20 and an adjacent portion of the nested or inner disk assembly 18 when nested as noted in FIG. 3 for reasons to be explained.

In a second embodiment of the nested automatically separable flying disk assembly 12 as noted in FIGS. 8 and 9, the central nub projection 32 is replaced by an adjustable central nub projection 29. The adjustable central nub projection 29 is provided with a nub support hub 31 having a central threaded hole 33 therein and a threaded screw member 35 mounted within the central threaded hole 33.

The threaded screw member 35 is adjustably movable axially within the central threaded hole 33 to provide a variance in spacing between the central body section 20 and the nested or inner disk assembly 18 for reasons to be noted.

As noted in FIG. 9, the threaded screw member 35 has been screwed outwardly of the central threaded hole 33 from its position in FIG. 8 so as to provide a greater spacing therein as noted by a letter "E" in FIG. 9. The reasons for this adjustable feature will be explained in more detail.

Figure 5:
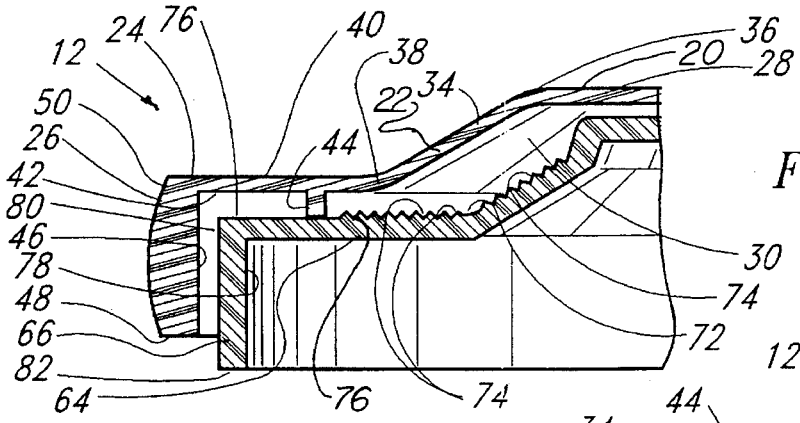
FIG. 5 is an enlarged fragmentary sectional view taken along line 5—5 in FIG. 3.

As noted in FIG. 5, the intermediate or inclined support section 22 is provided with an inclined ring portion 34 extended laterally and downwardly from the central body section 20 at a preferred angle of 30 degrees plus or minus 5 degrees. The inclined ring portion 34 has a top connector portion 36 integral with the circular peripheral edge of the central body section 20 and a flange connector portion 38 is integral with the outer flange section 24.

The outer flange section 24 is of a flat plate construction similar to the central body section 20 and extended parallel to the central body section 20. The outer flange section 24 is provided with a top wall surface 40 and an inner wall surface 42. The inner wall surface 42 is provided with a pair of diametrically opposed flange nub projections 44 of a generally cylindrical shape for abutting a portion of the nested or inner disk assembly 18 when nested as shown in FIG. 4.

The peripheral rim section 26, as noted in FIG. 5, extends downwardly and perpendicular to the outer flange section 24. The peripheral rim section 26 is provided with 1) an inner wall 46; 2) a bottom wall 48; and 3) an arcuate outer wall 50.

The inner wall 46 is extended downwardly perpendicular to the inner wall surface 42 of the outer flange section 24 and the bottom wall 48 is extended laterally and perpendicular to the inner wall 46. The diameter across the inner wall 46 is referred to as an "inner diameter".

As shown collectively in FIGS. 4 and 5, the nested or inner disk assembly 18 is provided with a top wall section 58 having an outer circular periphery thereof integral with an intermediate or inclined flange section 62 which, in turn, is integral with an outer connector flange section 64 having its outer edge integral with a peripheral flange section 66.

The top wall section 58 is of a flat plate construction extended in a parallel plane to the central body section 20 of the outer or cover disk assembly 16 when in the nested condition as noted in FIG. 4.

The intermediate or inclined flange section 62 is provided with a first inclined portion 68 integral with a second inclined portion 70. The second inclined portion 70 is extended at an angle relative to the top wall section 58 in a plane parallel to the intermediate or inclined support section 22 of the outer or cover disk assembly 16. The angle of the second inclined portion 68 is 30 degrees plus or minus 5 degrees relative to the top wall section 58.

The second inclined portion 70 includes an upper surface 72 having a plurality, preferably seven (7) thereof, concentric aerodynamic ridges 74. The concentric aerodynamic ridges 74 are stepped upwardly approximately 30 degrees for aerodynamic purposes to be explained.

The outer connector flange section 64 is in a spaced parallel plane relative to the top wall section 58. The outer connector flange section 64 includes a top wall portion 76 having a plurality, preferably nine (9) thereof, concentric aerodynamic ridges 74 as previously described on the upper surface 72 of the second inclined portion 70 on the intermediate or inclined flange section 62.

The peripheral flange section 66 is extended perpendicular and downwardly from the outer connector flange section 64. The peripheral flange section 66 includes an inner flange surface 78 and an outer flange surface 80 which are interconnected by an outer bottom wall surface 82. The diameter across the outer flange surface is referred to as an "outer diameter".

The peripheral flange section 66 resembles a cylindrical ring structure having the outer flange surface 80 spaced parallel and adjacent to the inner wall 46 of the peripheral rim section 26 of the outer or cover disk assembly 16 when in the nested condition of FIG. 4 for reasons to be explained.

Figure 6:
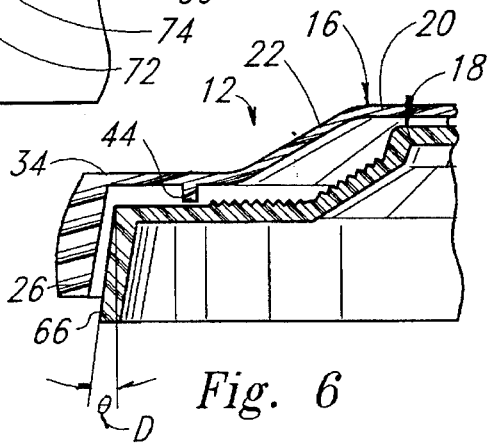
FIG. 6 is a second embodiment of the nested automatically separable flying disk assembly of this invention similar to FIG. 5.

In a second embodiment of the nested automatically separable flying disk assembly 12 of this invention as noted in FIG. 6, the peripheral rim section 26 of the outer or cover disk assembly 16 has been angled outwardly at an angle indicated by a letter "D". Concurrently, the peripheral flange section 66 of the nested or inner disk assembly 18 has been inclined outwardly equal to the angular distance indicated by the letter "D".

The inner wall 46 of the outer or cover disk assembly 16 and the outer flange surface 80 of the nested or inner disk assembly 18 have been angled while having the inner wall surface 46 and the outer flange surface 80 extended in spaced parallel planes. Due to the outwardly inclined configuration thereof as indicated by the letter "D", different aerodynamic characteristics are obtained by the nested automatically separable flying disk assembly 12 during flight.

By inclining the peripheral rim section 26 and the peripheral flange section 66 as noted by the letter "D" in FIG. 6, this would decrease time before separation of the outer or cover disk assembly 16 from the nested or inner disk assembly 18 as will be explained.

Figure 7:
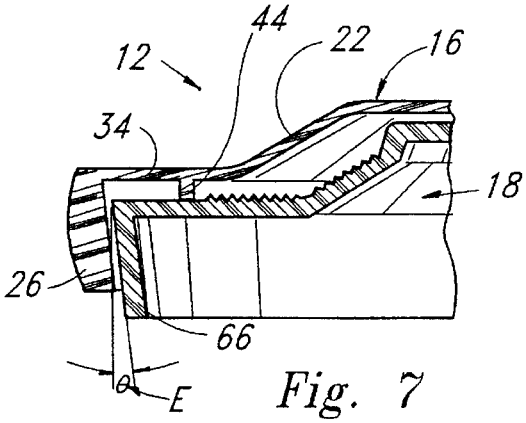
FIG. 7 is a third embodiment of the nested automatically separable flying disk assembly of this invention similar to FIG. 5.

A third embodiment of the nested automatically separable flying disk assembly 12 is noted in FIG. 7 wherein the peripheral rim section 26 of the outer or cover disk assembly 16 is inclined inwardly at an angle as shown by the letter "E" in FIG. 7. Concurrently, the peripheral flange section 66 of the nested or inner disk assembly 18 is inclined inwardly equal to the angle noted by the letter "E".

This is similar to the embodiment as noted in FIG. 6 except that the inner wall 46 of the peripheral rim section 26 of the outer or cover disk assembly and the outer flange surface 80 of the peripheral flange section 66 of the nested or inner disk assembly 18 are inclined, spaced, and parallel to each other, both being inclined inwardly and angled equal to the letter "E". This causes a difference in aerodynamic characteristics of the nested automatically separable flying disk assembly 12.

By having the peripheral rim section 26 and the peripheral flange section 66 inclined inwardly at the angle set forth by the letter "E" as noted in FIG. 7, this will increase the time of flight before separation of the disk assemblies 16, 18.

USE AND OPERATION OF THE INVENTION

In the use and operation of the nested automatically separable flying disk assembly 12 of this invention as noted in FIG. 4, it is seen that the nested or inner disk assembly 18 may be placed on a support surface and the outer or cover disk assembly 16 is mounted thereabout to enclose same. In this first embodiment, there is separation between the outer or cover disk assembly 16 and the nested or inner disk assembly 18 provided by the central nub projection 32 on the central body section 20 and by the spaced diametrically opposed flange nub projections 44 on the outer flange section 24.

In this condition, it is noted that there is separation between the disk assemblies 16, 18 equal to the height of the central nub projection 32. It is obvious that the height of the subject nub projections 32 , 44 can be varied to vary the aerodynamic characteristics and time of separation between the disk assemblies 16, 18.

The use of the nub projections 32, 44 of various heights will increase or decrease spacing between the bottom wall 48 of the peripheral rim section 26 and the outer bottom wall surface 82 of the peripheral flange section 66 as noted by the letter "A" in FIG. 8.

As noted in FIG. 9, the spacing between the disk assemblies 16, 18 can be regulated through use of the adjustable central nub projection 29 or height of the nub projections 32, 44 to achieve a spacing equal to the letter "B" in FIG. 9.

In the spacing "B" as distinguished from the spacing "A", this would allow a greater amount of air flow to reach between the central body section 20 and the top wall section 58 so that the time of separation between the disk assemblies 16, 18 will be shortened due to the aerodynamic air forces during flight as will be noted.

As noted in FIG. 9, the threaded screw member 35 can be screwed outwardly from the central threaded hole 33 to achieve a greater spacing between the disk assemblies 16, 18 as noted by the letter "B" in FIG. 9 as compared to the similar spacing noted by the letter "A" in FIG. 8. This adjustable feature will increase and decrease the time required for separation of the disk assemblies 16, 18.

On use of the nested automatically separable flying disk assembly 12, it is obvious that the assembled nested condition, as noted in FIGS. 3 and 4, allows for it to be projected by an exercise and/or game player 14 as noted in FIG. 1.

Initially, the throwing game player 14 would selectively decide which direction, spin, and angle in which to propel the nested automatically separable flying disk assembly 12 towards the receiving game player(s) 14.

As noted in FIG. 10, the propelled nested automatically separable flying disk assembly 12 will be projected forwardly at an angle as noted by an arrow 98. At this time, there would be an air flow as noted by an arrow 106 which would act upon a forward portion of the propelled and, perhaps, rotating the nested automatically separable flying disk 12. Then, aerodynamic forces provide a force, as noted by an arrow 102, upwardly on the outer or cover disk assembly 16 and, concurrently, with a force, as noted by an arrow 104, downwardly on the nested or inner disk assembly 18.

As the nested automatically separable flying disk assembly 12 continues in flight, the aerodynamic forces noted by arrow 106 would continue to separate the disk assemblies 16, 18. Due to the aerodynamic forces, the outer or cover disk assembly 16 would tend to move upwardly as noted by the upper arrow 98 in FIG. 11 and, concurrently, the nested or inner disk assembly 18 would tend to move downwardly as noted by the lower arrow 98 as shown in FIG. 11.

As the initially separated disk assemblies 16, 18 proceed in flight as noted in FIG. 12, it is noted that each will proceed in their own path acted on by their own independent air flow 106 and, depending on the speed imparted, rotational movement, and angular inclination on initially being propelled by the throwing game player 14, the disk assemblies 16, 18 will proceed independently as noted by the respective arrows 98 in FIG. 12.

It is seen that the nested automatically separable flying disk assembly 12, as noted in FIGS. 4 and 5, will proceed with aerodynamic characteristics due to the spacing therebetween which can be constant due to the central nub projections 32 and the flange nub projections 44 depending on their various heights thereof to increase and decrease the separation between the central body section 20 and the top wall section 58. The spacing therebetween can be adjusted through the adjustable central nub projection 29 as previously explained.

The aerodynamic characteristics and separation are further enhanced by use of the aerodynamic ridges 74 on the intermediate or inclined flange section 62 and the outer connector flange section 64 of the nested or inner disk assembly 18. As air flow enters and contacts the aerodynamic ridges 74, this would create a turbulence of the air flow which will assist and affect the desired separation of the disk assemblies 16, 18.

The time of separation of the disk assemblies 16, 18 can be decreased through use of the second embodiment, as noted in FIG. 6, having the peripheral rim section 26 and the peripheral flange section 66 with the inner wall 46 and outer flange surface 80 inclined at the angle indicated by the letter "D".

The angle indicated by the letter "D" can be further increased thus achieving a faster separation of the disk assemblies 16, 18 during the method of game play.

Further, the time before separation of the disk assemblies 16, 18 can be increased when using the embodiment as noted in FIG. 7. The spaced parallel inner wall 46 and outer flange section 80 are inclined inwardly at an angle as noted by the letter "E". Again, the angle noted by the letter "E" can be varied to further increase the time of flight before separation of the disk assemblies 16, 18.

The aerodynamic ridges 74 are each inclined upwardly having two inclined surfaces at 60 degrees plus or minus 5 degrees relative to an adjacent supporting surface. The aerodynamic ridges 74 can be altered to provide various aerodynamic characteristics. It has been found that the 60 degree plus or minus 5 degrees with a 60 degree angle at the outer tip of the aerodynamic ridges 74 provides the preferred embodiment of this invention.

In regard to the structural features and resultant aerodynamic characteristics of the nested automatically separable flying disk assembly 12, an air space must exist between the inner diameter of the inner wall 46 of the peripheral rim section 26 of the outer or cover disk assembly 16 and the outer diameter of the outer flange surface 80 of the nested or inner disk assembly 18 as indicated by a letter "C" in FIG. 8.

In test results, it has been found that an inner diameter of 8.860 inches of the peripheral rim section 26 nested into an outer diameter of 8.765 of the outer flange surface 80 results in a circumferential spacing therebetween of 0.048 inches which is the distance "C". This circumferential spacing results in good flight and subsequent separation of the disk assemblies 16, 18.

Of course, the weight and outer contour of the disk assemblies 16, 18 varies their flight characteristics and the preferred embodiment of the nested automatically separable flying disk assembly 12 has been disclosed herein.

The air flow separation is affected by the distance (inclined area) between the inclined, spaced, parallel inclined ring portion 34 and the second inclined portion 70 when the disk assemblies 16, 18 are in the nested condition of FIG. 4. Concurrently, the number, shape, and size of the aerodynamic ridges 74 will affect turbulence in the subject "inclined area" and resultant air flow separation.

The adjustable central nub projection 29, the central nub projection 32, and the flange nub projections 44 can be of various sizes and shapes being individually and collectively known as a separator means.

While the invention has been described in conjunction with preferred specific embodiments thereof, it will be understood that this description is intended to illustrate and not to limit the scope of the invention, which is defined by the following claims:

We claim:

1. A nested automatically separable flying disk assembly, comprising:

a) an outer disk assembly includes a central body section having a first inner diameter;

b) an inner disk assembly including a top wall section and a first outer diameter;

c) a separator means between said outer disk assembly and said inner disk assembly;

d) said first outer diameter is less than said first inner diameter to permit said inner disk assembly to be nested within said outer disk assembly with said separator means maintaining a predetermined spacing between said outer disk assembly and said inner disk assembly to permit air flow therebetween during flight to aid in flight separation therebetween; and e) said separator means having a nub projection which is adjustable to increase or decrease said predetermined spacing.

2. A nested automatically separable flying disk assembly as described in claim 1, wherein:

a) said nub projection having a threaded screw member mounted within a central threaded hole with said threaded screw member movable longitudinally to adjust said predetermined spacing between said outer disk assembly and said inner disk assembly to permit air flow therebetween in lesser or greater amounts to provide an adjustment feature in the time of aerodynamic flight before separation is achieved between said outer disk assembly and said inner disk assembly.

3. A nested automatically separable flying disk assembly as described in claim 1, wherein:

a) said outer disk assembly includes an intermediate or inclined support section integral with said central body section; and b) more than one flange nub projection mounted between said outer disk assembly and said inner disk assembly cooperating with said nub projection to maintain said predetermined spacing between said outer disk assembly and said inner disk assembly to assure air flow between said outer disk assembly and said inner disk assembly.

4. A nested automatically separable flying disk assembly as described in claim 3, wherein:

a) said intermediate or inclined support section extended generally and laterally at an angle of approximately 30 degrees plus or minus 5 degrees relative to said central body section to achieve an air flow resistance and aerodynamic characteristics during flight.

5. A nested automatically separable flying disk assembly as described in claim 4, wherein:

a) said nested or inner disk assembly having said top wall section integral with an intermediate flange section which, in turn, is integral with an outer connector flange section being integral with said peripheral flange section; and b) said intermediate flange section extended at an angle downwardly relative to said top wall section of 30 degrees plus or minus 5 degrees thereby maintaining the air flow space between said intermediate or inclined support section and said intermediate flange section to maintain the air flow therebetween.

6. A nested automatically separable flying disk assembly as described in claim 5, wherein:

a) said intermediate flange section and said outer connector flange section provided with aerodynamic ridges therein to provide the turbulence therein during air flow to aid in separation of said outer disk assembly from said inner disk assembly during flight.

7. A nested automatically separable flying disk assembly, comprising:

a) a cover disk assembly including a central body section and a peripheral rim section having an inner wall defining a first inner diameter;

b) a nested disk assembly including a top wall section and a peripheral flange section having an outer flange surface defining a first outer diameter of a size less than said first inner diameter to permit nesting of said peripheral flange section within said peripheral rim section;

c) said cover disk assembly includes a plurality of spaced ones of nub projections extended toward and engagable with said nested disk assembly when in the nested condition to maintain an air flow therebetween to assure separation between said cover disk assembly and said nested disk assembly during propelled flight thereof; and d) said nub projections of equal height to maintain equal spacing between said central body section and said top wall section when said nested disk assembly is nested within said cover disk assembly.

8. A nested automatically separable flying disk assembly as described in claim 7, wherein:

a) said nub projection is adjustable to increase or decrease said separation.

9. A nested automatically separable flying disk assembly as described in claim 7, wherein:

a) said nub projection having a threaded screw member mounted within a central threaded hole; and b) said threaded screw member can be moved longitudinally within said central threaded hole to provide an adjustable feature to selectively regulate spacing between said cover disk assembly and said nested disk assembly to change time before separation between said cover disk assembly and said nested disk assembly during flight which can be either increased or decreased through use of said threaded screw member.

10. A nested automatically separable flying disk assembly as described in claim 7, wherein:

a) said peripheral rim section and said peripheral flange section angled outwardly relative to said central body section and said top wall section, respectively, and positioned in parallel, spaced planes thereby providing for greater air flow therebetween which will decrease the time of flight before separation of said cover disk assembly from said nested disk assembly.

11. A nested automatically separable flying disk assembly as described in claim 7, wherein:

a) said peripheral rim section and said peripheral flange section inclined inwardly relative to said central body section and said top wall section, respectively, thereby increasing the time of flight before separation of said cover disk assembly from said nested disk assembly.

12. A nested automatically separable flying disk assembly, comprising:

a) an outer cover disk assembly including a central body section integral with an inclined support section; an outer flange section integral with said inclined support section; and said outer flange section integral with a peripheral rim section having an inner diameter;

b) an inner nested disk assembly including a top wall section integral with an inclined flange section; an outer connector flange section integral with said inclined flange section; and said outer connector flange section integral with a peripheral flange section having an outer flange surface with an outer diameter:

c) said outer diameter less than said inner diameter allowing said inner nested disk assembly to be nested within said outer cover disk assembly;

d) a separator means mounted between said outer cover disk assembly and said inner nested disk assembly to maintain a predetermined separation for air flow therebetween during flight to achieve automatic separation after an initial aerodynamic flight in the nested condition; and e) said separator means includes a plurality of nub projections to maintain equal spacing between said outer cover disk assembly and said inner nested disk assembly when in the nested condition prior to being propelled into the atmosphere in flight.

13. A nested automatically separable flying disk assembly as described in claim 12, wherein:

a) said separator means having an adjustable central nub projection, whereupon said predetermined separation is adjustable between said outer cover disk assembly and said inner nested disk assembly.

14. A nested automatically separable flying disk assembly as described in claim 12, wherein:

a) said peripheral rim section and said peripheral flange section extended at an angle directed outwardly from said central body section and said top wall section, respectively, to achieve an air flow therebetween which decreases the time required for separation of said outer cover disk assembly from said inner nested disk assembly during aerodynamic flight.

15. A nested automatically separable flying disk assembly as described in claim 12, wherein:

a) said peripheral rim section and said peripheral flange section extended at an angle inwardly of said central body section and said top wall section, respectively, to achieve air flow therebetween which would require a greater time of flight before separation occurs between said outer cover disk assembly and said inner nested disk assembly during aerodynamic flight.

* * * * *